United States Patent [19]

Perlov

[11] Patent Number: 4,915,017

[45] Date of Patent: Apr. 10, 1990

[54] DIAPHRAGM AND A DIAPHRAGM-ACTUATED FLUID-TRANSFER CONTROL DEVICE

[75] Inventor: Gena Perlov, Haifa, Israel

[73] Assignee: D. F. Laboratories Ltd., Haifa, Israel

[21] Appl. No.: 256,976

[22] Filed: Oct. 13, 1988

[30] Foreign Application Priority Data

Oct. 26, 1987 [IL] Israel ..... 84286

[51] Int. Cl.[4] ..... F01B 25/26; F01B 19/00; F16J 3/00

[52] U.S. Cl. ..... 92/5 R; 92/96; 92/98 R; 92/103 F; 92/103 M

[58] Field of Search ..... 92/5 R, 89, 90, 91, 92/92, 93, 96, 98, 103 R, 103 F, 103 SC, 103 M; 417/413, 374; 91/1, DIG. 4

[56] References Cited

U.S. PATENT DOCUMENTS

| | | | |
|---|---|---|---|
| 2,642,091 | 6/1953 | Morin | 92/90 |
| 3,028,878 | 4/1962 | Natho | 92/5 R |
| 3,093,086 | 6/1963 | Altoz et al. | 92/103 M |
| 3,131,638 | 5/1964 | Wilson et al. | 92/5 R |
| 3,249,022 | 5/1966 | Bolger | 92/103 SD |
| 3,661,060 | 5/1972 | Bowen | 92/5 R |
| 4,176,586 | 12/1979 | Stoll et al. | 92/5 R |

FOREIGN PATENT DOCUMENTS

| | | | |
|---|---|---|---|
| 2308029 | 4/1976 | France | 92/90 |
| 973922 | 11/1982 | U.S.S.R. | 92/89 |

*Primary Examiner*—Robert E. Garrett
*Assistant Examiner*—Thomas Denion
*Attorney, Agent, or Firm*—Bauer & Schaffer

[57] ABSTRACT

A diaphragm for a diaphragm-actuated fluid-transfer control device, which comprises a flexible, substantially non-stretchable diaphragm body of a substantially circular outline surrounded and delimited by a beaded rim, the body having a substantially dish-like, bi-stable shape invertible from the first stable state, in which a first body surface is convex and a second body surface, concave, to the second stable state, in which the first body surface is rendered concave and the second body surface, convex. The device further comprises at least one substantially rigid, elongated arm fixedly embedded in the diaphragm to a depth exceeding the radial width of the beaded rim, the free end of which arm projects beyond the beaded rim. There is also described a diaphragm-actuated fluid transfer control device including the diaphragm.

12 Claims, 8 Drawing Sheets

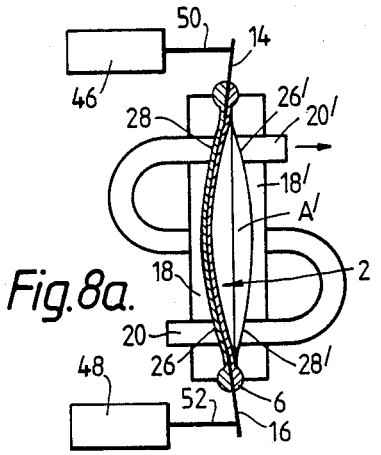
Fig.8a.
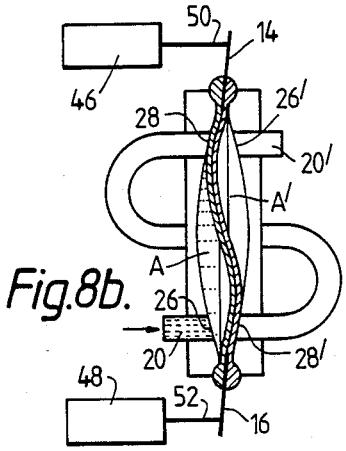
Fig.8b.
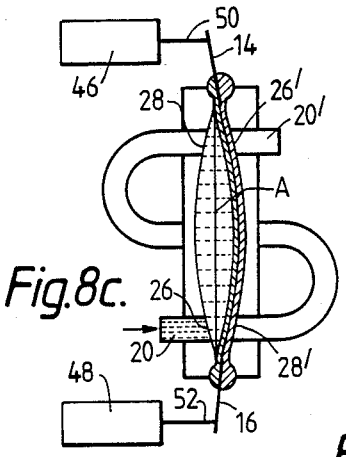
Fig.8c.
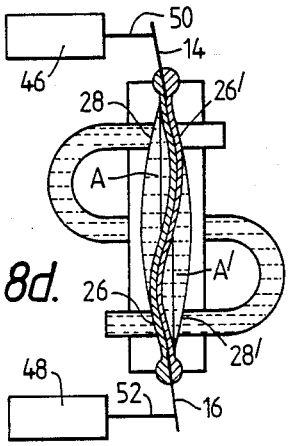
Fig.8d.
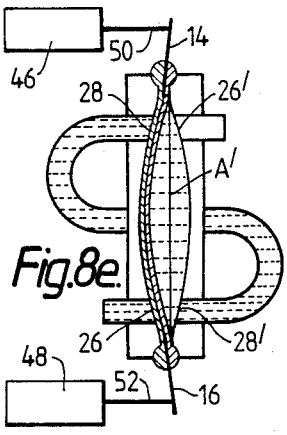
Fig.8e.
Fig.8f.
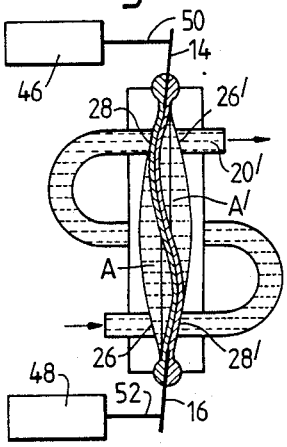
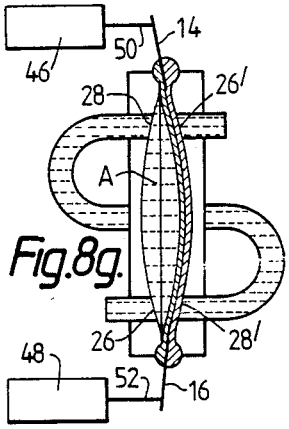
Fig.8g.

DIAPHRAGM AND A DIAPHRAGM-ACTUATED FLUID-TRANSFER CONTROL DEVICE

The present invention relates to a diaphragm for a diaphragm-actuated fluid-transfer control device. It further relates to a diaphragm-actuated fluid-transfer control device embodying such diaphragm.

While diaphragm-actuated devices for instance, diaphragm pumps, are known, they suffer from several disadvantages, the foremost of which is the need for inlet and outlet valves which sooner or later are always causes of trouble. Another drawback of conventional diaphragm pumps is the inevitable presence of "dead" volume which is likely to interfere with smooth operation and in any case prevents accurate determination and control of output, an important parameter in dosage and other medical applications. Also, conventional diaphragm devices cannot be used as proportioning valves by means of which two different fluids—say, hot and cold water—can be mixed in a predeterminable ratio.

It is one of the objects of the present invention to overcome the disadvantages and drawbacks of prior-art diaphragm-actuated devices such as pumps, valves, etc., and to provide a diaphragm which enables diaphragm-actuated devices to function without inlet and outlet valves, to have no "dead" volume and to be accurately controllable as to flow rates. It also permits the use of diaphragm-actuated devices for purposes not usually associated with diaphragms, such as proportioning valves, flowmeters, etc.

This the invention achieves by providing a diaphragm for a diaphragm-actuated fluid-transfer control device, comprising a flexible, substantially non-stretchable imperforate diaphragm body of a substantially circular outline surrounded and delimited by a beaded rim, said body having a substantially dish-like, bi-stable shape invertible from a first stable state in which a first body surface is convex and a second body surface concave, to a second stable state, in which said first body surface is rendered concave and said second body surface, convex, further comprising at least one substantially rigid, elongated arm fixedly embedded in said diaphragm to a depth exceeding the radial width of said beaded rim, the free end of which arm projects beyond said beaded rim.

The invention further provides a diaphragm-actuated fluid transfer control device, comprising a split housing, each housing half comprising a concave central portion delimited by a substantially circular groove, and a substantially plane, marginal portion constituting the plane along which said housing is split, at least one inlet and one outlet port means opening into the concave portion of at least one of said housing halves and leading via tube connectors to the outside of said device, a diaphragm comprised of a flexible, substantially non stretchable imperforate diaphragm body of a substantially circular outline surrounded and delimited by a beaded rim, which rim, in the assembled state of said device, is located in the respective circular grooves of said housing halves, between which halves said diaphragm is sealingly clampable, said diaphragm body having a substantially dish-like, bi-stable shape invertible from a first stable state, in which a first body surface is convex and snugly lies against the concave portion of one housing half, to a second stable state, in which said first body surface is rendered concave and said second surface, convex, snugly lying against the concave portion of the other housing half, said diaphragm further comprising at least one substantially rigid, elongated arm fixedly embedded in said diaphragm to a depth exceeding the radial width of said beaded rim, the free portion of which arm projects outwardly beyond said beaded rim, and actuator means adapted to apply a force to the projecting portion of said at least one arm, whereby at least a portion of said bi-stable diaphragm is inverted from said first state towards said second state.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 11:
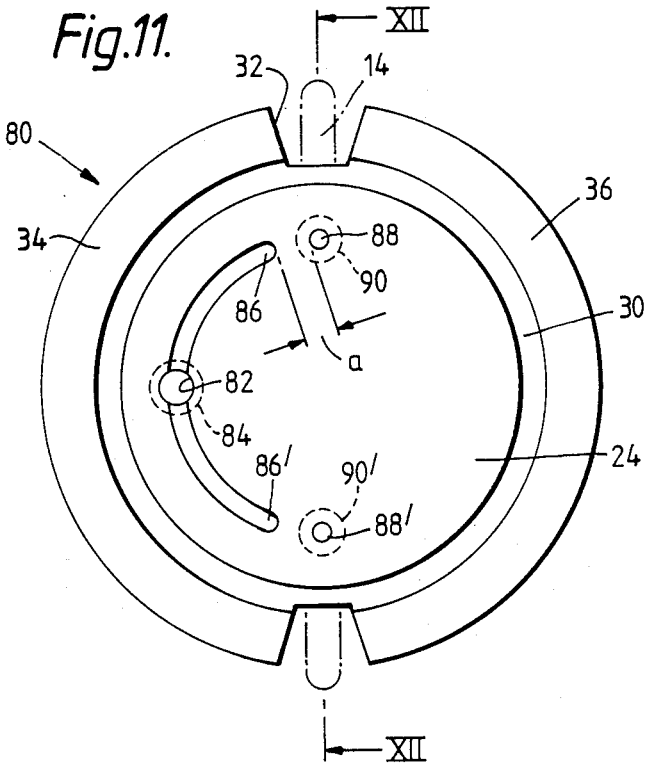
FIG. 11 is a housing half of a third embodiment of the device according to the invention, seen from the side of its concavity.
Figure 12A:
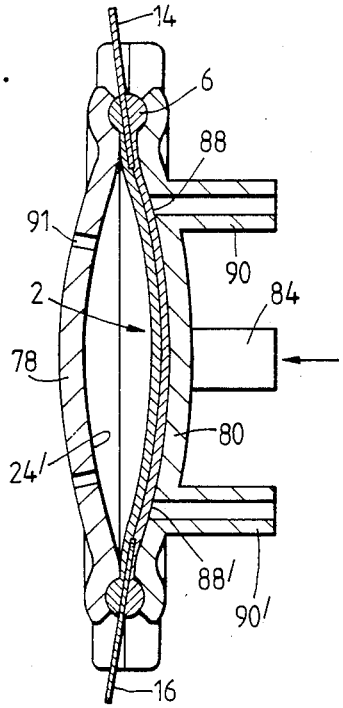
Figure 12B:
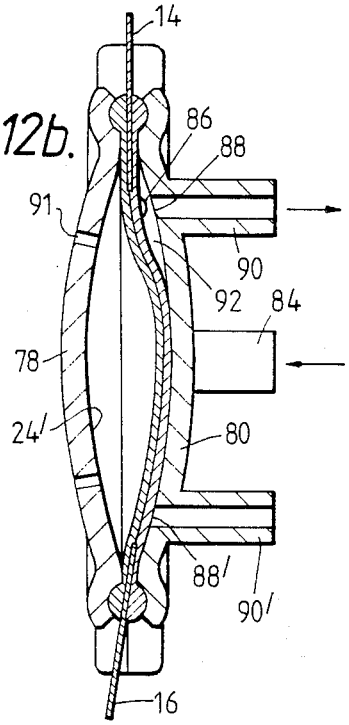
Figure 12C:
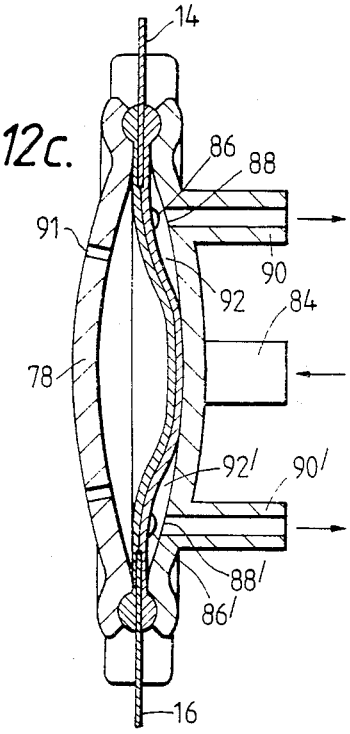
Figure 13:
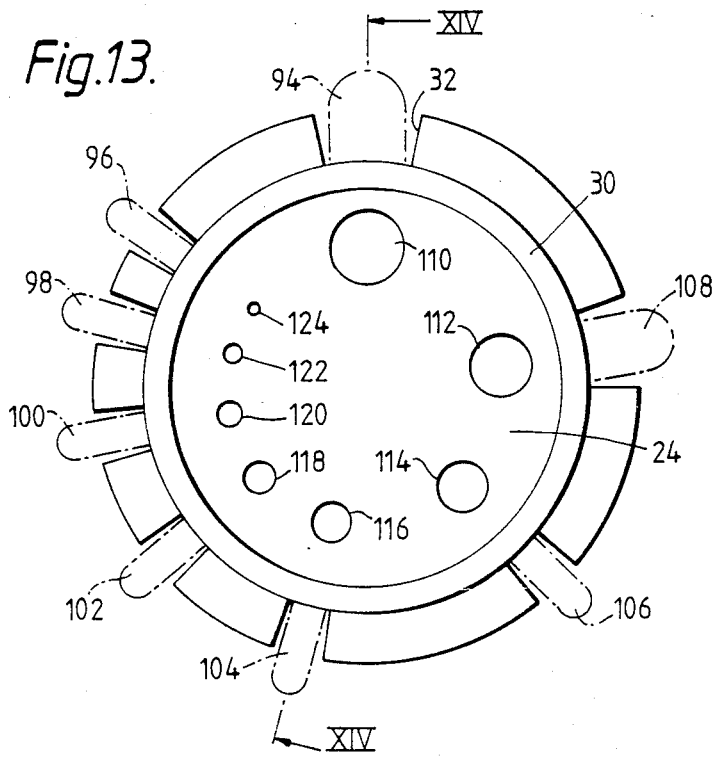
Figure 14:
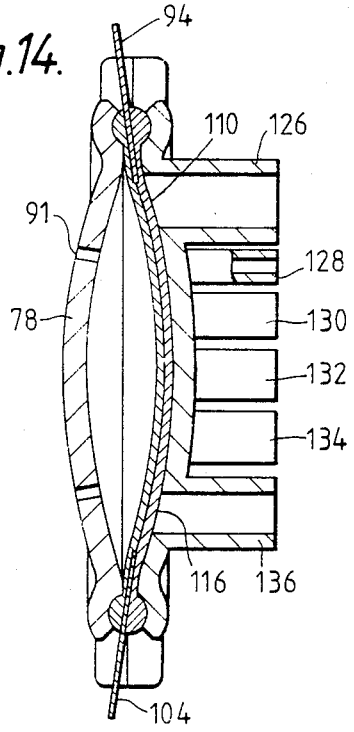
Figure 15:
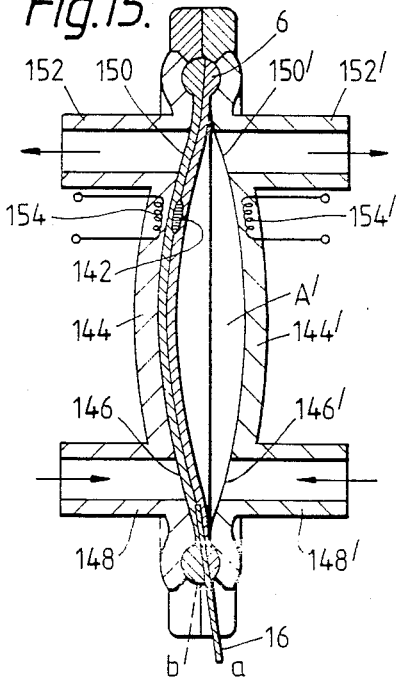
Figure 16:
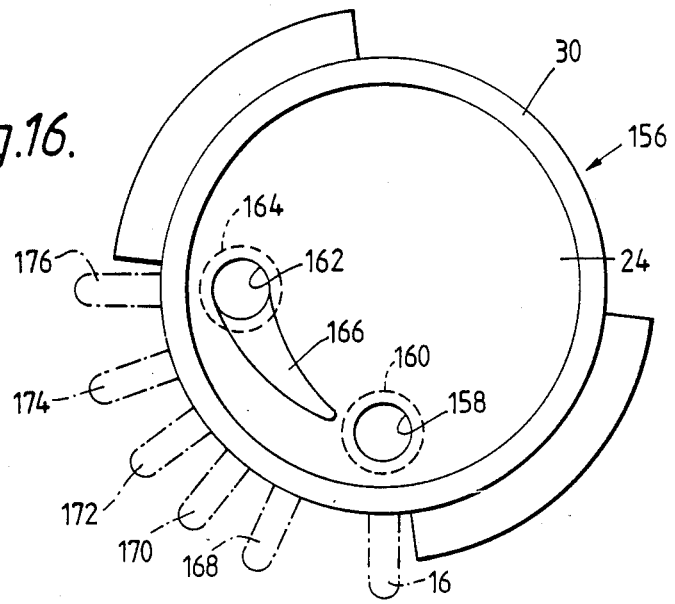
Figure 17:
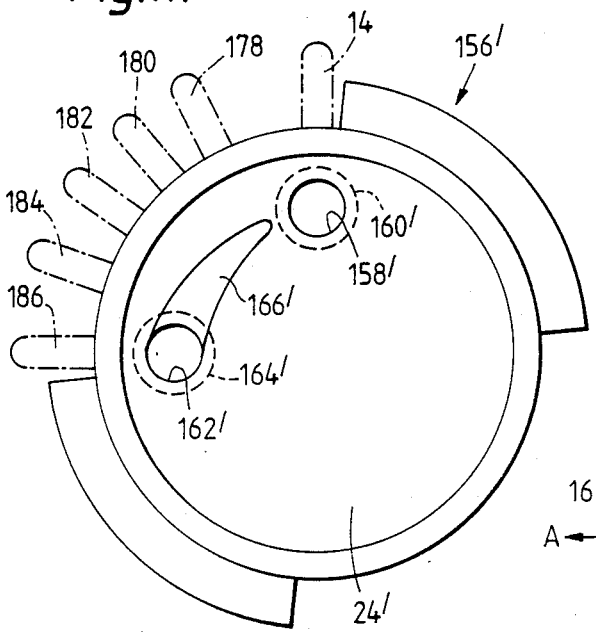
Figure 18:
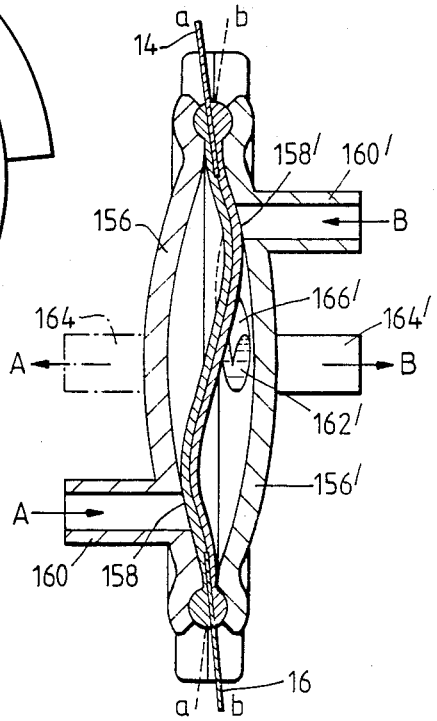

FIGS. 12*a*–12*c* illustrate three different positions of the diaphragm of the embodiment of FIG. 11, in cross section taken along plane XII—XII of FIG. 11, FIG. 13 represents a housing half of a fourth embodiment of the device according to the invention, seen from the side of its concavity;

FIG. 14 is a view, in cross section taken along plane XIV—XIV of the housing half of FIG. 13;

FIG. 15 is a cross-sectional view of a fifth embodiment of the device according to the invention;

FIG. 16 shows a first housing half of the fifth embodiment of the invention, seen from the side of its concavity, FIG. 17 represents the second housing half of this embodiment, and FIG. 18 is a cross-sectional view of this embodiment of the device.

Figure 1:
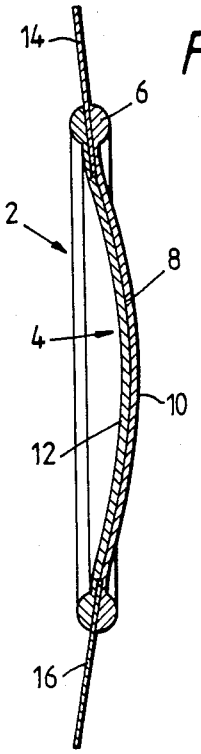
FIG. 1 is a cross-sectional view of a first embodiment of the diaphragm according to the invention.
Figure 2:
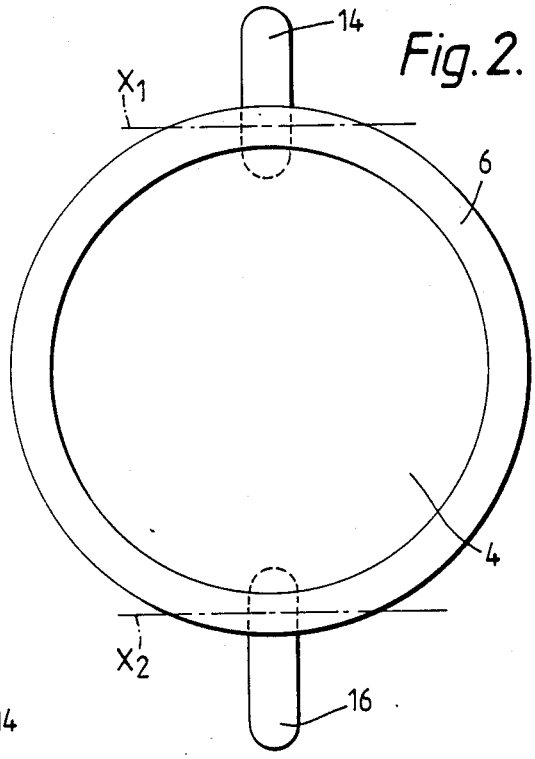
FIG. 2 is a front view of the diaphragm of FIG. 1.

Referring now to the drawings, there is seen in FIGS. 1 and 2 a diaphragm 2 comprised of a flexible, substantially non-stretchable imperfote diaphragm body 4 of a circular outline surrounded and delimited by a beaded rim 6. The diaphragm body 4 consists of a central, relatively thin, springily resilient layer 8 made of such materials as spring steel or beryllium bronze, covered on both sides by a layer 10, 12 of a relatively pliable and soft material such as rubber or a flexible plastic. The diaphragm body 4 has a dish-like, bi-stable shape invertible from the state shown in FIG. 1, in which the body surface on the right is convex and the body surface on the left, concave, to a second stable state, in which, due to inversion, the surface on the right is rendered concave and the surface on the left, convex.

There are further seen two elongated, diametrically opposite arms 14, 16 made of a rigid material such as steel and, as is clearly seen, particularly in FIG. 2, partly embedded in the diaphragm body 4 and partly projecting beyond the rim 6. As will be explained in conjunction with the several diaphragm-actuated devices represented in FIGS. 3–18, these arms serve to effect total or partial inversion of the bi-stable diaphragm 2, and the dash-dotted lines $X_1$, $X_2$ denote the respective axes about which the arms 14 and 16 are tilted to produce the desired inversion.

FIGS. 3 to 8*g* represent a first embodiment of a diaphragm-actuated device according to the invention, being a diaphragm pump.

Figure 3:
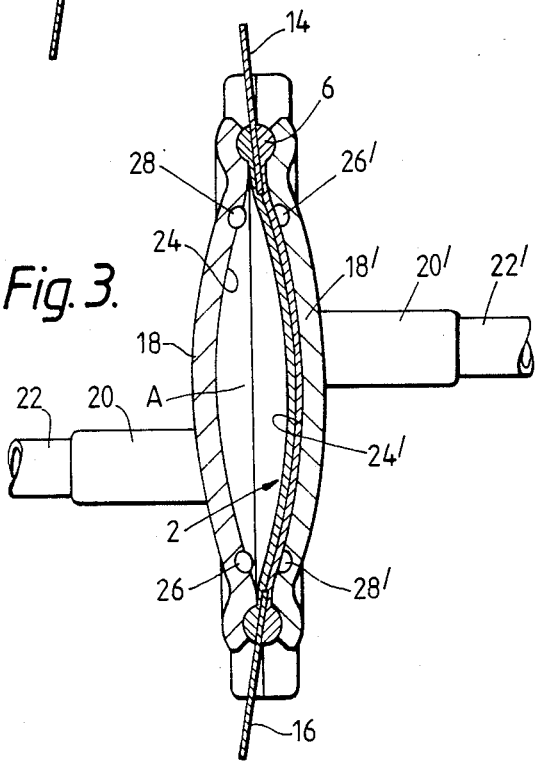
FIG. 3 shows a cross-sectional view of a first embodiment of a diaphragm device according to the invention.

There is seen in FIG. 3 a split housing consisting of two identical housing halves 18, 18′ between which is clamped the diaphragm 2 of FIG. 1. Each housing half is provided with a tube connector 20 (20′), to which is respectively connectable a length of tubing 22 (22′), one serving as suction line, the other as output line. It is further seen that each housing half is provided with a central, concave portion 24 (24′) which, in conjunction with the diaphragm surface facing it, defines an action space A (A′) (A′ being formed when, as will be explained further below in conjunction with FIGS. 8*a*–8*g*, the diaphragm 2 of FIG. 3 is flipped over to its second stable state). Also seen are inlet ports 26, 26′ and outlet ports 28, 28′, the locations and configurations of which are seen to better advantage in the front view of FIG. 4.

Figure 4:
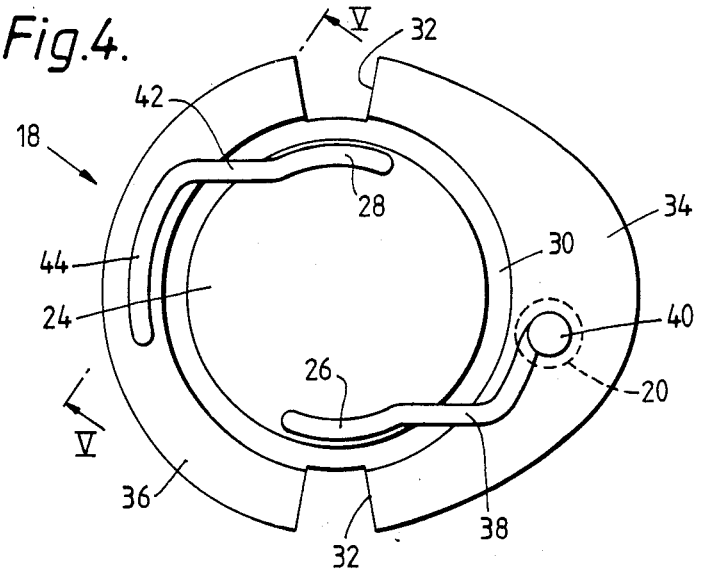
FIG. 4 represents a housing half as seen from the side of its concavity.

FIG. 4, a frontal view of housing half 18 shows the central, concave housing portion 24 as delimited by a circular groove 30, advantageously of a rectangular cross section, which, in the assembled state of the device, sealingly accommodates the beaded rim 6 of the diaphragm 2. Starting from the outer edge of the groove 30, there extends a plane, marginal housing portion that constitutes the parting plane along which the split housing is divided. Two diametrically opposite notch-like cuts 32, the purpose of which will become apparent further below, subdivide the marginal housing portion into two subportions 34, 36.

As can be seen, the inlet and outlet ports 26 and 28 are located diametrically opposite in the peripheral zone of the concave portion 24 and have the shape of at least partly arcuate grooves. At the end of its arcuate portion, the inlet port continues in the form of a straight groove 38 and crosses the circular groove 30 into the marginal subportion 34, leading into the bore 40 of the inlet tube connector 20. The depth of the straight groove 38 is greater than that of the circular groove 30, so that when, in assembly, the beaded rim 6 is sealed in the circular groove 30, liquid can pass below the rim 6 into the inlet port 26.

The outlet port 28 is of a similar design, except that its straight groove 42 leads into the marginal subportion 38 and continues as an arcuate groove 44 extending some distance across the horizontal center line of the housing half 18.

Figure 5:
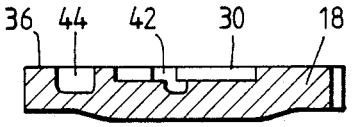
FIG. 5 is a view, in cross section taken along plane V—V of FIG. 4, of the housing half of FIG. 4.

The cross-sectional view of FIG. 5 clearly illustrates the "underpass" arrangement of the straight grooves 42 and 38.

Figure 6:
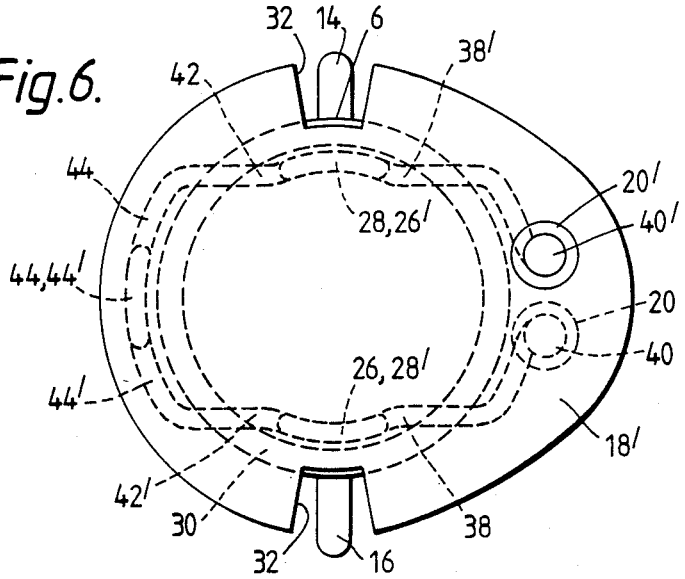
FIG. 6 is a view of the pump as assembled, showing the parts and passageways in dashed lines.

FIG. 6 shows the device in the assembled state, with the diaphragm inserted and clamped between the housing halves 18 and 18′. For sake of clarity, no clamping means such as screws and nuts have been shown. The purpose of the notch-like cuts 32 becomes immediately obvious: they provide room for the arms 14, 16 to tilt, as mentioned in conjunction with FIG. 2.

Particular attention should be paid to some aspects of the ducting (details of which will be explained in conjunction with the schematic drawings of FIGS. 8 to 8*g*): while in FIG. 6 the congruent parts 26, 28′ appear to be superposed, they are in fact separated by the diaphragm 2. The same is also true of ports 28, 26′ (see also FIG. 3). The arcuate portions 44 and 44′, on the other hand, overlap for a certain length (see FIG. 6), and, along this overlap, indeed communicate with one another. Port 28 thus communicates with port 28′ according to the following sequence: 28→42→44→44′→42′→28′.

Figure 7:
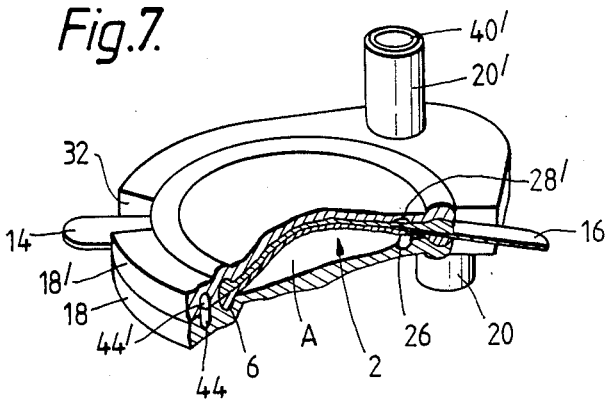
FIG. 7 is a perspective view, in partial cross section, of the first embodiment of the diaphragm device according to the invention, FIGS. 8*a*–8*g* schematically illustrate the sequence of inversion stages of the diaphragm and the consequent pumping action.

FIG. 7 is a perspective view, in partial cross section, of the embodiment of FIG. 3. The overlap connection between portions 44 and 44′ is clearly seen.

The operational principle and sequence are explained in the schematical drawings of FIGS. 8*a*–8*g*.

As already mentioned, inversion of the diaphragm 2, part or total, is effected by manipulating the arms 14, 16, more particularly by selectively tilting them about the axes $X_1$, $X_2$ (see FIG. 2). This is done with the aid of actuators 46. 48 (FIGS. 8*a*–8*g*) which can be any device producing a controllable motion, advantageously, but not necessarily, linear. Such devices include, e.g., solenoids having a plunger pulled into the solenoid body when the solenoid is under current, and returned to its position of rest by spring force, when the current is cut off. Another suitable actuator device would be a linear stepping motor. While the latter is more expensive, its action is less sudden and, therefore, smoother. One member, preferably the body of whatever actuator is used, is hinged to an element stationary relative to the housing of the device according to the invention, and the other, moving, member of the actuator is articulated to the arm of the device.

It should be noted that the external, S-like duct connecting the ports 28 and 28′ represents the above mentioned internal connection 28→42→44→44′→42′→28′ in FIG. 6.

FIGS. 8*a* to 8*c* explain the "priming" stage of the device, while FIGS. 8*d* to 8*g* illustrate the pumping stages proper. During continuous pumping, the stage of FIG. 8*g* is followed by the stage shown in FIG. 8*d*.

In FIG. 8*a* the pump is completely empty, the diaphragm 2 clings to the concavity of the left housing half 18 and the actuator rods 50, 52 are both in the "out" position. Action space A′ is still full of air.

In FIG. 8*b*, the rod 52 of actuator 48 has moved to the "in" position, tilting the lower arm 16 to the left, which causes half the diaphragm 2 to be flipped to the right, opening the inlet port 26, closing the inlet port 28′ and initiating the formation of action space A, which obviously results in fluid being drawn in through the connector 20 and the open inlet port 26. The air displaced from space A′ exits through the still open outlet port 26′ and the connector 20′.

In the stage represented in FIG. 8*c*, the rod 50 of the actuator 46 has also moved to the "in" position, tilting arm 14 to the left, which causes inversion of the diaphragm to be completed and the action space A to be completely filled. Outlet port 28 is now open as well, while outlet port 26′ and inlet port 28′ are closed by the diaphragm.

In FIG. 8*d* the lower actuator rod 52 has moved to the "out" position, tilting arm 16 to the right, which causes half the diaphragm to be flipped to the left. This results in the space A being progressively reduced and a space A′ being progressively created. As ports 28 and 28′ are now open, the fluid from the shrinking space A is peristaltically displaced through port 28 into the passageway 28→28′ and fills the expanding space A′.

In FIG. 8*e*, actuator rod 50 having moved to the "out" position, diaphragm inversion is completed and action space A′ is completely filled. Ports 28, 26 are closed by the diaphragm, ports 26′, 28′ are open.

FIG. 8*f* illustrates the "delivery" stage. Actuator rod 52 has returned to the "in" position, flipping half the diaphragm to the right, thereby reducing space A′ and peristaltically expelling the displaced fluid through port 26′ and connector 20′. At the same time, space A is expanded, drawing in fluid through the suction or inlet port 26, now open.

In the stage represented by FIG. 8*g*, the actuator rod 50 has moved to the "in" position, causing diaphragm inversion to be completed, with ports 28 and 26 open, and ports 26′ and 28′ closed. The situation is now as in FIG. 8*c*, except that now the entire system is fluid-filled. The next stage would correspond to the stage depicted in FIG. 8*d*, the pumping cycle comprising stages 8*g* 8*d* 8e 8*f* 8*g*, etc.

The device discussed in the aforegoing and illustrated in FIGS. 1 to 8 is inexpensive, consisting as it does of three major parts only, namely diaphragm 2 and two housing halves 18, 18′, of which the latter are identical and can be made as plastic moldings. This makes the device particularly useful for one-time use, such as an infusion pump, where tubing 22 (FIG. 3) would lead to the dripping chamber of the infusion set, and tubing 22′, to the intravenous hypodermic needle. After use, the pump would be discarded, only the actuators 46, 48 being retained for use with further pumps. With less critical applications and less stringent sterility requirements, the pump is easily dismantled for cleaning.

Figure 9:
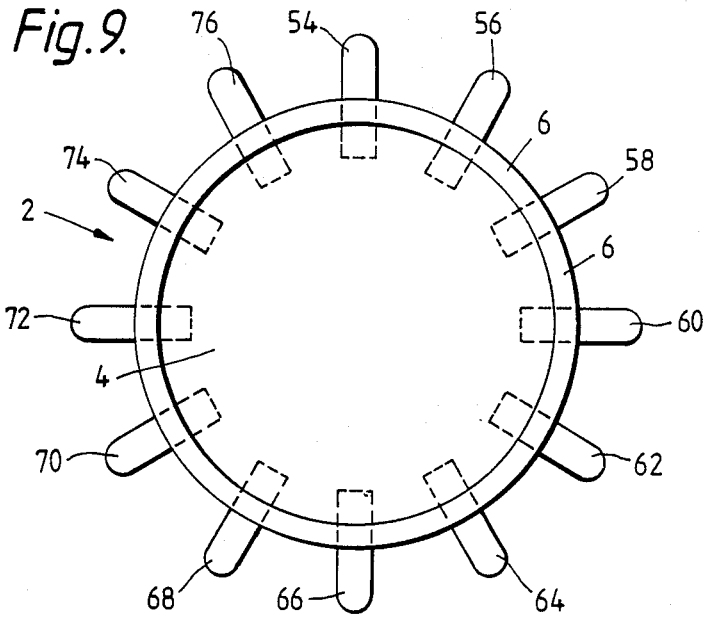
FIG. 9 represents a second embodiment of the diaphragm according to the invention, having a plurality of arms.

Another embodiment of the diaphragm according to the invention is shown in FIG. 9. As can be seen, the diaphragm 2, otherwise similar to that shown in FIGS. 1 and 2, is provided with a larger number of arms, symmetrically arranged along the periphery of the diaphragm, each arm being provided with its own actuator (not shown). Inversion of the diaphragm 2 follows the scheme of FIGS. 8*a*–8*g*, except that it is more gradual, making pumping action much smoother. Setting out from the state shown in FIG. 8*a*, the first arm to be flipped over is arm 66 (FIG. 9). This is followed by simultaneously flipping over arms 68, 64, then 70, 62; 72, 60; 74, 58; 76, 56 and, finally, 54. Re-inversion follows the reverse sequence, starting from arm 54.

Figure 10:
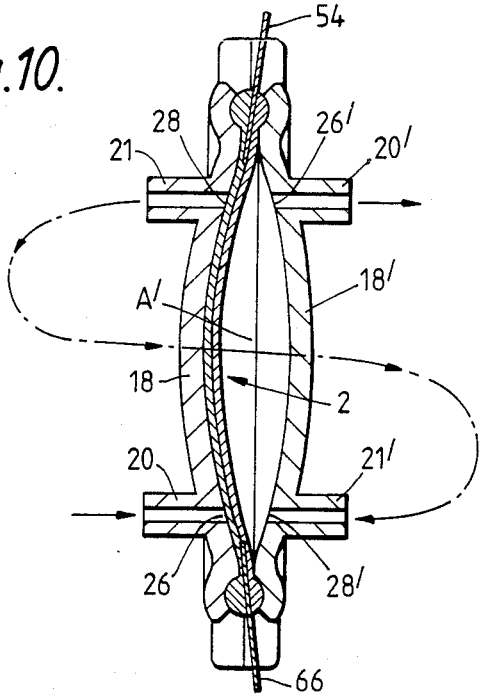
FIG. 10 is a cross-sectional view of an embodiment of the device incorporating the diaphragm of FIG. 9.

A pump using the diaphragm 2 of FIG. 9 is seen in FIG. 10. Because of the large number of arms, internal ducting, as was the case in the embodiment of FIGS. 3–8*g* is no longer feasible. The present embodiment has therefore four separate tube connectors, 20, 21′ for the inlet ports 26, 28′, and 20′, 21 for the outlet ports 26′, 28. These ports, via their respective tube connectors, can be connected in various ways, one being indicated by the dash-dotted line, which stands for a piece of tubing connecting the outlet port 28 with the inlet port 28′. This is in fact the externalized ducting scheme of FIGS. 4 and 6. as represented in the schematic drawings of FIGS. 8*a*–8*g*. However, other connecting schemes are also possible. such as two separate suction lines leading to the tube connectors 20 and 21′, and two output lines connected to the connectors 20′ and 21. In this manner, the present embodiment can serve, e.g. for the continuous mixing, at a precise ratio of 1:1, of two different liquids.

The arms 54–76, suitably modified, could also be actuated with the aid of a system of rotating face or other cams which manipulate the arms in the required sequence.

The embodiment represented in FIGS. 11 and 12*a*–12*c* is a multi-way stop-cock valve and uses the diaphragm 2 of FIG. 2. The split housing of this embodiment consists of two different halves 78, 80, of which the latter is shown in FIG. 11.

There is seen the concave portion 24. the groove 30 which accommodates half the beaded rim 6 of the diaphragm 2 (the other half being located in the groove 30 of the other housing half, 78), the plane, marginal portions 34 and 36, separated by the notch-like cuts 32, in which is indicated the position of the arms 14 and 16. There is further seen an inlet port 82 located close to the periphery of the concave portion 24, which port 82 is adapted to communicate with an inlet line via a tube connector 84. Into the inlet port 82 lead two arcuate grooves 86, 86′ which end at points close to, but do not actually reach, outlet ports 88, 88′. These outlet ports lead via tube connectors 90, 90′ to output lines (not shown).

The other housing half, 78, has no function except to be the partner with housing half 80 in clamping the diaphragm 2 between them. To keep pressure in the space between its concave portion 24′ and the diaphragm 2 atmospheric, several small venting holes 91 are provided. As was the case with previous embodiments, the electromechanical actuators adapted to act on the arms 14 and 16 are not shown.

FIG. 12*a* shows the valve in the closed position. As the diaphragm 2 closes both outlet ports, 88 and 88′, fluid from the inlet line which enters, and fills, the grooves 86, 86′ also when the diaphragm is in the fully stable state as in FIG. 12*a*, cannot cross the gaps a between the ends of the grooves 86, 86′ and the outlet ports 88, 88′, because these gaps are fully covered by the diaphragm 2. In this position, the arms 14, 16 are both slanted towards the left.

In FIG. 12*b*, the arm 14, previously slanting, has been not flipped to the other side, but merely straightened. As a consequence, a small portion of the diaphragm 2 is detached from the concavity 24 of housing half 80, producing a limited space 92 which includes the gap a between the end of groove 86 and the outlet port 88 that, in the state shown in FIG. 12*a*, was covered by the diaphragm 2. As a result of this slight detachment, fluid can now pass from the groove 86 (which, as will be remembered is always fluid-filled as long as the inlet connector 84 is connected to a source of pressurized fluid) into the outlet port 88 and thence through the tube connector 90, now in the "ON" state.

Although not specifically shown, an analogous state is achieved when, instead of arm 14, arm 16 is "half-flipped", obviously resulting in a connection between the inlet connector 84 and the lower outlet tube connector 90' through limited space 92'.

In FIG. 12*c*, both arms, 14 and 16, have been "half-flipped", as a result of which both outlet tube connectors, 90 and 90', are now in the "ON" state.

FIGS. 13 and 14 illustrate another application of the diaphragm according to the invention, a control valve, permitting a practically continuous range of outputs from zero to a maximum for a given input, The diaphragm 2 used is similar to that of FIG. 9, except that the arms 94–108 are not spaced at uniform intervals, and at least two arms, 94 and 108, are wider than the others. In FIG. 13, which illustrates the active housing half 80, the diaphragm arms 94–108 are indicated by dash-dotted lines. The other housing half, 78, is identical to, and serves the same purpose as, that of the previous embodiment (FIGS. 12*a* 12*c*), except that the number of notch-like cuts 32 is obviously larger.

FIG. 13 shows the housing half 80 as seen from the side of its concavity 24. There are provided a relatively large inlet port 110 and a number n of progressively smaller outlet ports 112–124. The cross-sectional area S of each outlet port is defined by the expression $S_{m6} = 2^{m-1}$, where m is the ordinal number of the outlet port, starting from the smallest port. The cross-sectional area S of the inlet port is obviously at least the sum of the respective cross-sectional areas of the outlet ports:

$$S_{total} = \sum_{m=1}^{m=n} 2^{m-1}.$$

By suitable combinations of active outlet ports, a practically continuous range of outputs from zero to 100% of the input is attainable.

With the inlet port 110 opened by flipping its arm 94, the required outlet port or combination of outlet ports is activated by flipping their respective arms, which, by detaching, starting from these ports, a relatively narrow, well defined strip-like section of the diaphragm 2, permit these ports to communicate with the inlet port 110, the diaphragm portion around which has also been detached from the concavity 24 by flipping over its arm 94.

FIG. 14 shows the valve in cross section. The inlet port 110 is associated with an inlet tube connector 126 and each of the outlet ports is associated with a separate outlet tube connector. The port-connector pairs are thus 124–128; 122–130; 120–132; 118–134; 116–136; 114–138, and 112–140. The last two connectors are not shown, as they are located in the cut-away part of FIG. 14. Connectors 128 to 140 are separately connected to a manifold (not shown), from which emerges a single output line.

FIG. 15 represents another device, in which the diaphragm according to the invention is used as a flowmeter of the positive-displacement type. The diaphragm 2 is similar to that shown in FIG. 2, except that it has only one arm, 16, and that it incorporates a ferromagnetic body 142 embedded in the diaphragm 2, the purpose of which body will become apparent further below. There are provided two identical housing halves 144, 144', each with inlet ports 146, 146', associated with inlet tube connectors 148, 148', and outlet ports 150. 150', associated with outlet tube connectors 152, 152'. The two tube lengths (not shown) attached to the inlet connectors 148, 148' join up to form a single inlet or suction line, and the two tube lengths (also not shown) attached to the outlet connectors 152, 152' join up to form a single outlet or delivery line.

Embedded in, or closely attached to, the housing halves 144, 144', there are provided induction coils 154, 154' at such a location that, with the diaphragm fully inverted, one of these coils is in close proximity to the ferromagnetic body 142. This proximity obviously affects the inductance of whatever coil the body 142 is close to at any particular instance, thereby producing a signal indicating that the diaphragm has in fact completed an inversion as caused by the actuator-produced flipping-over of the arm 16. As the volumes of the action space A' (and, after inversion, A) are constant and known, and as each completed diaphragm inversion causes displacement of the fluid filling A' (or A), counting inversions is in fact equivalent to measuring flow.

In operation, the flowmeter is "primed" by once energizing the actuator (not shown) that flips the arm 16 from position a to position b. This will persistaltically empty space A' through port 150', starting from below, and draw in fluid through Port 146. As soon as this first inversion is completed and, at the same time, the now created action space A filled, a signal is produced by coil 154' which, via a feedback circuit, activates the actuator which returns the arm 16 from position a to position b, initiating the peristaltic displacement of the fluid from space A, ending, upon complete inversion, with coil 154 producing a signal that initiates the next flip-over, and so on. The flow rate is thus the number of diaphragm inversions per unit time times the volume of the action space A (or A').

FIGS. 16 to 18 represent a proportioning valve for two fluids A and B differing either in temperature or in composition, or in both.

The diaphragm used is of the multi arm type as in FIG. 9, except that the arms are concentrated in two diametrically opposite quadrants. The two housing halves 156, 156' are identical, but mutually angularly offset by 180°. There are seen an inlet Port 158, an inlet tube connector 160, an outlet port 162 and an outlet tube connector 164 all for fluid A, an inlet port 158', an inlet tube connector 160', an outlet port 162' and an outlet tube connector 164', all for fluid B, (Port 162 and connector 164 cannot be seen in FIG. 18, as they are located in the cut-away portion; for better understanding, connector 164 is indicated by dash-dotted lines).

There are also seen two lobe-like recesses 166, 166' in the respective housing halves 156 and 156' which have a narrow beginning close to the respective inlet ports 158, 158' and become progressively wider as they approach, and eventually lead into, the outlet ports 162, 162'.

In FIG. 18, arm 14 is seen in the "a" position, and arm 16, in the "b" position. In the ensuing state of the diaphragm 2, the flow of both fluids is cut off, as the diaphragm obturates both inlet ports, 158 and 158'. To permit flow of both fluids, arm 14 must be flipped to the "b" position, and arm 16, to the "a" position. By manipulating arms 168 to 186 ("ghosted in" partly in FIG. 16, partly in FIG. 17), and thus, the diaphragm, it is possible to, say, obturate part of the lobe-like recess 166 which controls the flow of fluid A while at the same time exposing part of recess 166', which controls the flow of fluid B, it being obvious that the flow of each fluid is determined by what happens in each case to be the greatest width of the exposed portion of the respective lobe-like recess.

In studying FIGS. 16 and 17, it should be noted that these views were obtained by opening the assembled housing halves 156, 156' like an oyster, housing half 156 to the left, and housing half 156' to the right. In the assembled state of these halves the groups of arms 16, 168–176, and 14, 178–186 will assume their above-mentioned positions along two diametrically opposite quadrants.

If the purpose of the device is to produce a mixture of two fluids at a constant mixing ratio, the outputs of the two outlet tube connectors 164, 164' are joined, as would be the case in, e.g., a hot-and-cold water mixing battery.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A diaphragm for a diaphragm-actuated fluid-transfer control device, comprising a flexible, substantially non-stretchable, substantially circular imperforate body surrounded and delimited by a beaded rim, said body having a first surface and an oppositely disposed second surface, and said body having a substantially dish-like, bi-stable shape invertible from a first stable state in which the first body surface is convex and the second body surface is concave to a second stable state in which said first body surface is rendered concave and said second body surface is rendered convex; and at least one substantially rigid, elongated arm fixedly embedded in said body to a depth exceeding the radial width of said beaded rim, the free end of said arm projecting beyond said beaded rim.

2. The diaphragm as claimed in claim 1, wherein said body comprises a central, relatively thin, springily resilient layer covered on each of its respective surfaces by a layer of a relatively pliable and soft material.

3. The diaphragm as claimed in claim 1, which includes two of said arms located in diametrical opposition.

4. The diaphragm as claimed in claim 1, which includes a plurality of said arms greater than two.

5. The diaphragm as claimed in claim 1, wherein at least one ferro-magnetic element is embedded in said body and comprises the moving member of a proximity sensor.

6. A diaphragm-actuated fluid transfer control device, comprising a split housing, each housing half having a concave central portion delimited by a substantially circular groove, a substantially plane, marginal portion constituting the plane along which said housing is split, and at least one inlet port means and at least one outlet port means opening into the concave portion of at least one of said housing halves and leading via tube connectors to the outside of said devices; a flexible, substantially non-stretchable, substantially circular imperforate diaphragm body surrounded and delimited by a beaded rim, said rim, in the assembled state of said device, being located in the respective circular grooves of said housing halves and being sealingly clampable between said halves, said diaphragm body having a first surface and an oppositely disposed second surface and having a substantially dish-like, bi-stable shape invertible from a first stable state in which the first body surface is convex and snugly lies against the concave portion of one housing half to a second stable state in which said first body surface is rendered concave and said second surface is rendered convex and snugly lies against the concave portion of the other housing half, said diaphragm body including at least one substantially rigid, elongated arm fixedly embedded in said diaphragm body to a depth exceeding the radial width of said beaded rim, the free portion of said arm projecting outwardly beyond said beaded rim, and actuator means adapted to apply a force to the projecting portion of said arm, whereby at least a portion of said diaphragm body is inverted from said first state towards said second state.

7. The device as claimed in claim 6, wherein said marginal portion is subdivided by at least two notch-like cuts into at least two subportions.

8. The device as claimed in claim 6, wherein said inlet port means and said outlet port means are respectively provided in the peripheral zone of the concave portion of each housing half, the inlet port means of one housing half being adapted to communicate with the suction line of said device, the outlet port means of said one housing half being adapted to communicate with the inlet port means of the other housing half, and the outlet port means of said other housing half being adapted to communicate with the output line of said device.

9. The device as claimed in claim 6, wherein at least one of said housing halves has one inlet port means and at least two outlet port means.

10. The device as claimed in claim 9, wherein said at least one housing half has more than two outlet port means, the cross-sectional area of which increases from port means to port means.

11. The device as claimed in claim 6, wherein at least one of said housing halves is provided with a lobe-like recess in the region of its concave portion, said lobe-like recess leading from said outlet port means to a point close to said inlet port means, said lobe-like recess being at its widest at said outlet port means and at its narrowest near said inlet port means.

12. The device as claimed in claim 6, wherein at least one of said housing halves is provided with at least one induction coil embedded in, or attached to, said housing half at a point close to its concave portion, said induction coil constituting the stationary member of a proximity sensor.

* * * * *